US007334808B2

(12) United States Patent
Fatzinger

(10) Patent No.: US 7,334,808 B2
(45) Date of Patent: Feb. 26, 2008

(54) TOW DEVICE

(76) Inventor: Edward C. Fatzinger, 5220 Pacific Concourse Dr., Suite 125, Los Angeles, CA (US) 90045

( * ) Notice: Subject to any disclaimer, the term of this patent is extended or adjusted under 35 U.S.C. 154(b) by 85 days.

(21) Appl. No.: 11/282,579

(22) Filed: Nov. 18, 2005

(65) Prior Publication Data

US 2007/0113771 A1 May 24, 2007

(51) Int. Cl.
*B62K 27/12* (2006.01)

(52) U.S. Cl. ..... 280/292; 114/253

(58) Field of Classification Search ..... 114/253, 114/254; 242/757.1; 280/292; 180/180
See application file for complete search history.

(56) References Cited

U.S. PATENT DOCUMENTS 581,309 A 4/1897 Savell
675,453 A 6/1901 Sturgess
3,326,175 A * 6/1967 Baker ..... 114/254
4,407,460 A 10/1983 Khudaverdian
4,969,610 A * 11/1990 Taylor et al. ..... 242/371
D334,960 S 4/1993 Goodman
6,270,100 B1 8/2001 Wunderlick
6,286,847 B1 9/2001 Perrin
6,607,208 B2 8/2003 Dartland

FOREIGN PATENT DOCUMENTS

WO WO 98/40267 12/1998

* cited by examiner

*Primary Examiner*—Edwin Swinehart
(74) *Attorney, Agent, or Firm*—Cislo & Thomas, LLP

(57) ABSTRACT

A tow device having a mounting bracket adapted for vehicle mounting, a spring-loaded bobbin, a hollow telescoping rod, a tow line, and a handle. The hollow telescoping rod, which can be automatically extended, has one end attached to the mounting bracket while the other end is mounted for pivotal movement. The tow line extends longitudinally through the hollow telescoping rod and is attached to the handle at one end and the spring-loaded bobbin at the other end.

30 Claims, 4 Drawing Sheets

TOW DEVICE

BACKGROUND

1. Field of the Invention

This invention relates to a device for towing a skateboarder, inline skater, roller skater, roller skier, or similar rider behind a vehicle.

2. Description of the Related Art

Skateboarding, inline skating, roller skating, and roller skiing have become widely popular activities. At first, these devices were generally self-propelled by their users. For a different experience, however, many participants wish to be towed by another vehicle, such as a bicycle. Previously this was accomplished by requiring the skater to hold directly on to the vehicle. However this was unsafe because it required the skater to be within arm's length of the vehicle. Where the towing vehicle was a bicycle, the skater was exposed to the spinning rear wheel and rotating chain of the bicycle. So, there is a need for a mechanism to permit a skater to safely be towed by a vehicle. There is also a need for a tow device that can remain installed on the towing vehicle in a compact manner when not in use. There is further a need for a tow device that automatically extends from that compact manner when the device is in use.

It is one object of the present invention to provide a tow device with a telescopic guide rod and a retractable tow line to make the tow device compact when not in use. A further object of the invention is to provide a telescopic guide rod that automatically extends when the tow device is used. It is another object of the present invention to provide a tow device that pivots relative to the towing vehicle to reduce stress on the guide rod and the tow line. Yet another object of the invention is to provide a tow device that springs back to the direction of travel of the towing vehicle so the device remains in line behind the towing vehicle when the skater lets go of the device or when the device is not in use. One more object of the invention is to permit the tow device to be mounted to various types of vehicles.

SUMMARY

The embodiments disclosed herein are generally directed to a device for towing a skater behind a towing vehicle, the skater using a skating device such as a skateboard, inline skates, roller skates, or roller skis.

In one aspect of the invention, a tow device capable of towing a skateboarder, inline skater, roller skater, roller skier, or similar rider behind a vehicle comprises a hollow telescoping rod, a tow line, a handle, a spring-loaded bobbin, and a mounting bracket. The hollow telescoping rod has an attachment end and a cantilevered end, and the hollow telescoping rod is longitudinally adjustable between an extended position and a retracted position. The tow line has a bobbin end and a handle end, and the tow line extends longitudinally through the hollow telescoping rod. The handle is connected to the handle end of the tow line. The spring-loaded bobbin is attached at the bobbin end of the tow line, and it applies a tensile force to the bobbin end of the tow line. This tensile force tends to rewind the tow line onto the spring-loaded bobbin. The mounting bracket attaches the attachment end of the hollow telescoping rod to a vehicle.

In another aspect of the invention, the spring-loaded bobbin comprises a housing, an axle, a bobbin, and a helicoid spring. The axle is attached to the housing, and the bobbin is concentric to the axle. The helicoid spring has a first end attached to the axle and a second end attached to the bobbin and is concentric to the axle and the bobbin. The helicoid spring, when under tension, tends to rotate the bobbin about the axle. Since the tow line is connected to the bobbin, rotation of the bobbin by the helicoid spring tends to rewind the tow line onto the bobbin.

In yet another aspect of the invention, the tow device further comprises a structure for automatically elongating the hollow telescoping rod to its extended position when the tow line is unwound from the spring-loaded bobbin by a tensile force applied to the handle end of the tow line. In this aspect of the invention, as the tow line is unwound from the spring-loaded bobbin, an enlarged portion of the tow line engages a constricted portion of the hollow telescoping rod causing the hollow telescoping rod to extend in the direction of the tensile force applied to the handle end of the tow line. In this manner, the telescoping guide rod is fully extended as the tow line is entirely unwound from the spring-loaded bobbin.

In still another aspect of the invention, the structure for automatically elongating the hollow telescoping rod comprises:

(a) an aperture at the cantilevered end of the hollow telescoping rod through which the tow line extends; and (b) a tow line protuberance connected near the bobbin end of the tow line wherein the tow line protuberance is sized to allow it to pass through the hollow telescoping rod but not through the aperture, permitting the tow line protuberance to engage the aperture such that the hollow telescoping rod is elongated to its extended position when tension is applied to the handle end of the tow line.

In a further aspect of the invention, the telescoping guide rod is pivotally attached to the mounting bracket. In order to reduce stresses on the telescoping guide rod and tow line, the telescoping guide rod can pivot horizontally and vertically.

In yet another aspect of the invention, to increase stability the telescoping rod is spring loaded to return to the neutral position of the mounting bracket, where the neutral position is parallel to the direction of travel of the towing vehicle. This helps the device to remain in line behind the towing vehicle when the skater lets go of the device or when the device is not in use.

These and other aspects of the invention will become apparent from a review of the accompanying drawings and the following detailed description of the invention.

DESCRIPTION

The detailed description set forth below in connection with the appended drawings is intended as a description of the presently-preferred embodiments of the invention and is not intended to represent the only forms in which the present invention may be constructed or utilized. The description sets forth the functions and the sequence of steps for constructing and operating the invention in connection with the illustrated embodiments. However, it is to be understood that the same or equivalent functions and sequences may be accomplished by different embodiments that are also intended to be encompassed within the spirit and scope of the invention.

Figure 1:
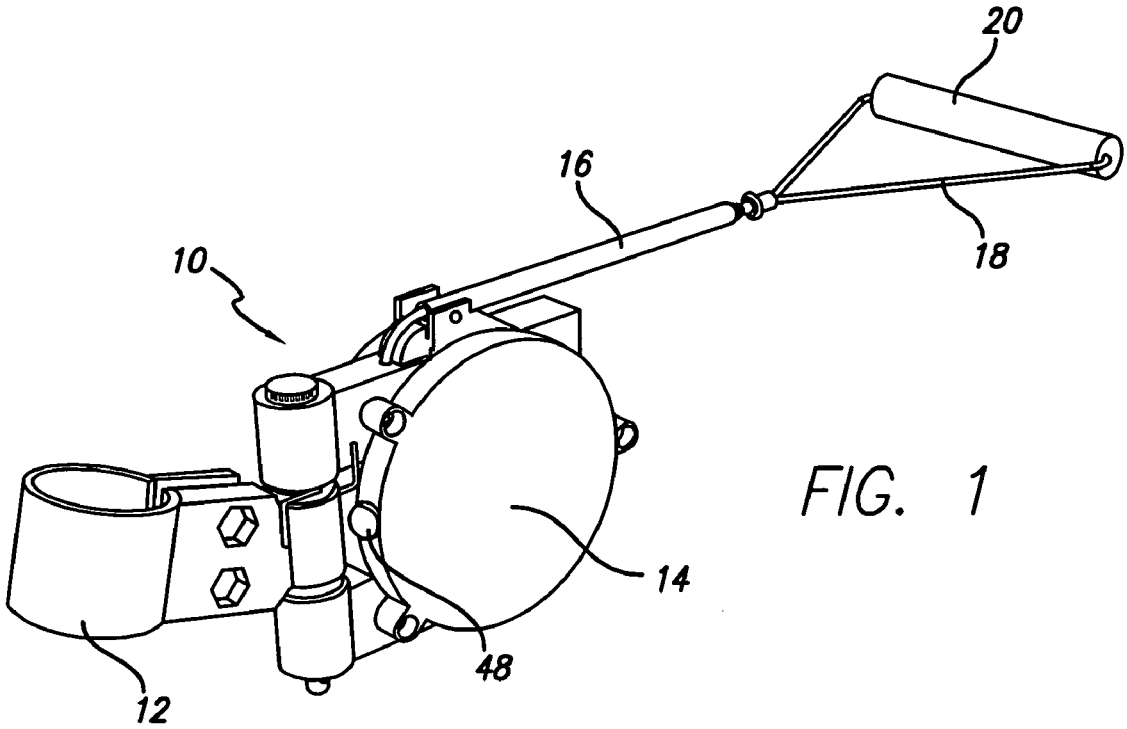
FIG. 1 is a perspective view of a version of the invention.
Figure 2:
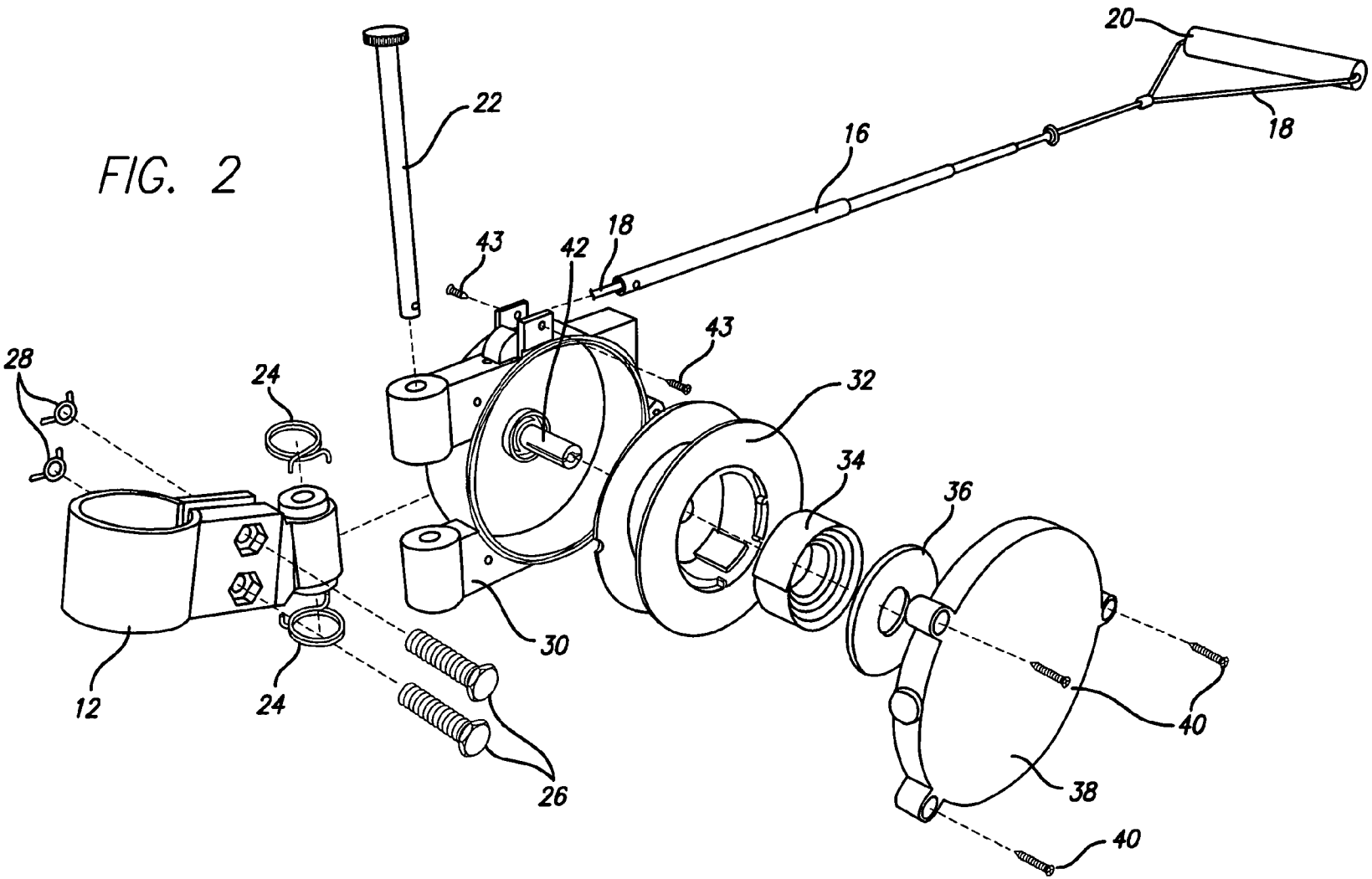
FIG. 2 is an exploded view of the version of the invention depicted in FIG. 1.

FIG. 1 shows a perspective view of one version of the present invention. A tow device 10 generally comprises a mounting bracket 12, a spring-loaded bobbin 14, a hollow telescoping rod 16, a tow line 18, and a handle 20. The hollow telescoping rod 16 has one end connected to the mounting bracket 12, while the other end is cantilevered. The hollow telescoping rod 16 is longitudinally adjustable between an extended position and a retracted position. In the version of the invention depicted in FIG. 1, from the cantilevered end to the handle end of the hollow telescoping rod 16, successive segments have a smaller diameter than the preceding segment. Thus, adjacent segments can slide inside of one another in a telescoping fashion to make the hollow telescoping rod 16 compact when not in use. The extended position is indicated in FIG. 2 while the retracted position is shown in FIG. 1. The tow line 18 extends longitudinally through the hollow telescoping rod 16 and is attached to the handle 20 at one end and the spring-loaded bobbin 14 at the other end. The spring-loaded bobbin 14 applies a tensile force to the bobbin end of the tow line 18. This tensile force tends to rewind the tow line 18 onto the spring-loaded bobbin 14. The mounting bracket 12 permits attachment of the tow device 10 to a towing vehicle. In the depiction of FIG. 1, the mounting bracket 12 is shaped to permit attachment to a bicycle frame. However, mounting bracket 12 can be shaped to permit attachment to a variety of towing vehicles.

FIG. 2 is an exploded view of one version of the present invention. In this embodiment, the hollow telescoping rod 16 is pivotally attached to the mounting bracket 12 by a hinge pin 22. Further, the hollow telescoping rod 16 may be biased by torsion springs 24 to return to the neutral position of the mounting bracket 12. This neutral position is parallel to the direction of travel of the towing vehicle. The torsion springs 24, therefore, help the device to remain in line behind the towing vehicle when the skater lets go of the device or when the device is not in use. The extent of pivoting is limited by a stop 48 (FIG. 1). Threaded bolts 26 and nuts 28 are used to clamp the mounting bracket 12 to a vehicle.

In one embodiment of the invention, the spring-loaded bobbin 14 (FIG. 1) comprises a spindle housing 30, a bobbin 32, a helicoid spring 34, and a cover plate 38. The spindle housing 30 includes an axle 42 attached to the spindle housing 30. The bobbin 32 is concentric to the axle 42. The helicoid spring 34 has a first end attached to the axle 42 and a second end attached to the bobbin 32. The helicoid spring 34 is concentric to the axle 42 and the bobbin 32, such that the helicoid spring 34, when under tension, tends to rotate the bobbin 32 about the axle 42. This rotation tends to rewind the tow line 18 around the bobbin 32.

The spring-loaded bobbin 14 (FIG. 1) may further comprise a spring retainer 36 to maintain the concentricity between the helicoid spring 34 and the bobbin 32. In this configuration, the spring retainer 36 encloses the helicoid spring 34 inside the hub of the bobbin 32.

In a version of the invention, the hollow telescoping rod 16 is attached to the spindle housing 30 by fasteners 43, which allow the hollow telescoping rod 16 to pivot in the vertical direction.

Figure 3:
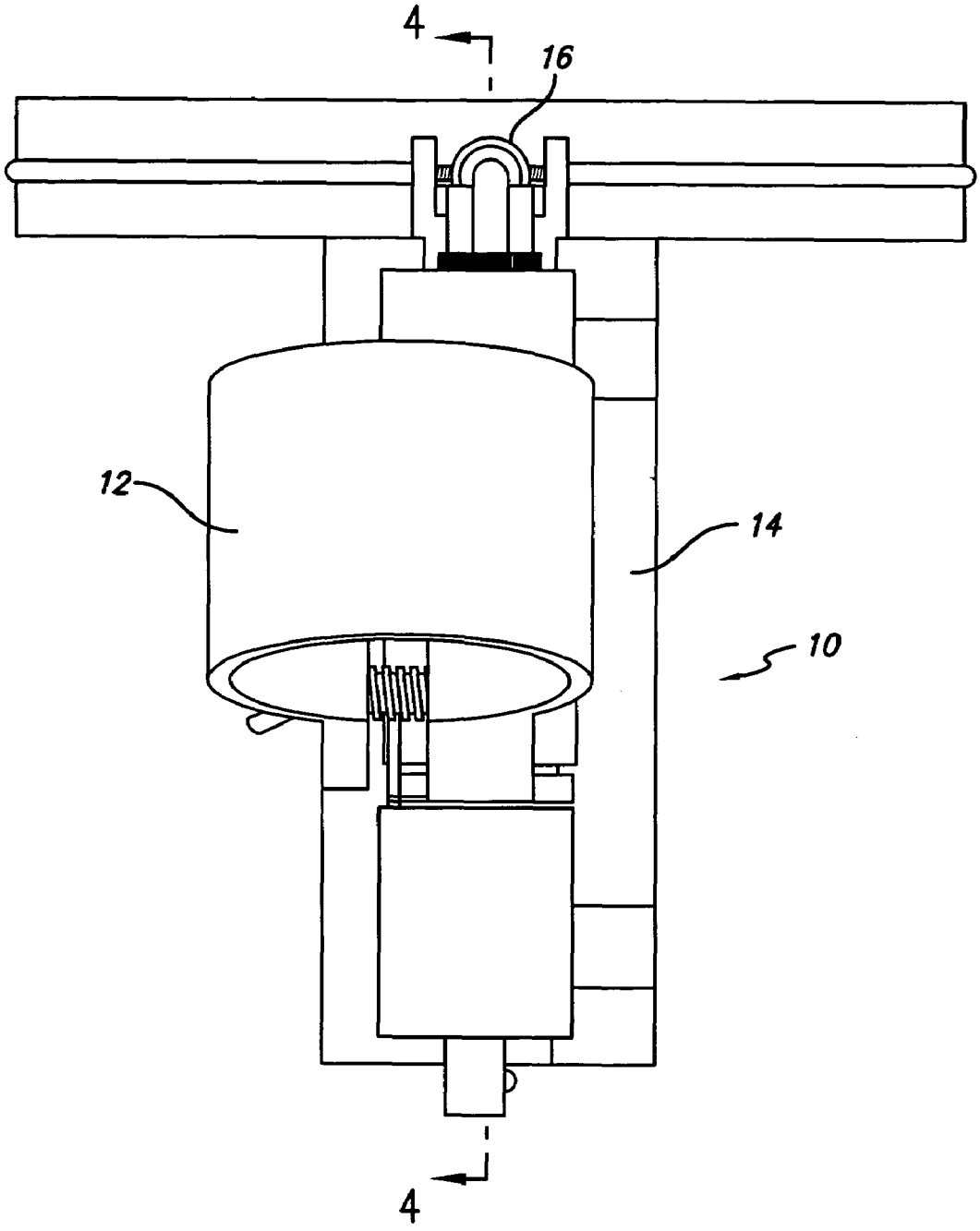
FIG. 3 is defines the cutaway shown in FIG. 4.
Figure 4:
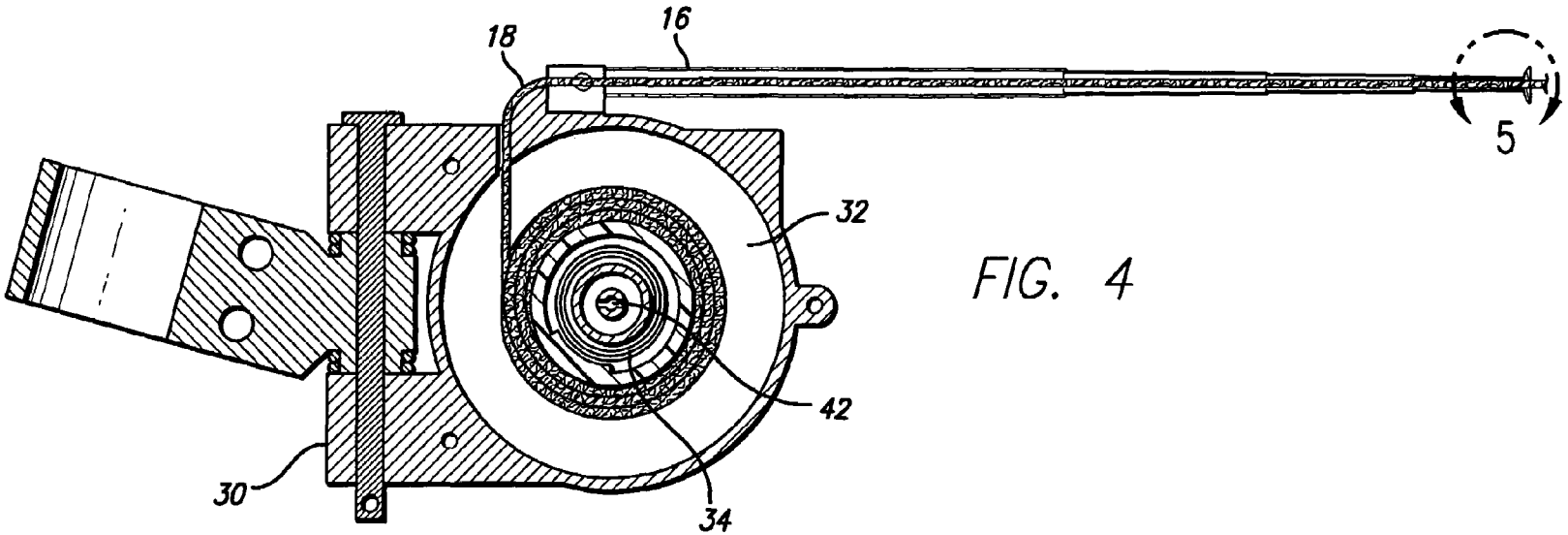
FIG. 4 is a front, cutaway view of the version of the invention depicted in FIG. 1.
Figure 5:
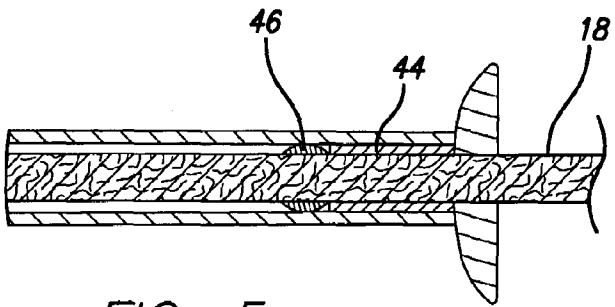
FIG. 5 is an enlarged view of the area defined in FIG. 4.

FIG. 3 defines the cutaway of a tow device 10 depicted in FIG. 4. Referring to FIG. 4 and FIG. 5, the hollow telescoping rod 16 may further comprise an aperture 44 and the tow line 18 may further comprise a tow line protuberance 46. The aperture 44 is located at the cantilevered end of the hollow telescoping rod 16, and the tow line 18 extends through the aperture 44. The tow line protuberance 46 is located near the bobbin end of the tow line 18. The tow line protuberance 46 is sized to allow it to pass through the hollowed center of the hollow telescoping rod 16 but not through the aperture 44. As the tow line 18 is withdrawn from the spring-loaded bobbin 14 (FIG. 1), the tow line protuberance 46 engages the aperture 44 such that the hollow telescoping rod 16 is elongated to its extended position. Therefore, the hollow telescoping rod 16 is automatically elongated to its extended position when tension is applied to the handle end of the tow line 18 and as the tow line 18 is entirely unwound from the spring-loaded bobbin 14 (FIG. 1).

Thus, as can be seen with the previously disclosed device of the invention a method for towing a skater or the like behind a vehicle comprising the steps of connecting the tow device to the vehicle, the tow device having a tow line, and an automatically extending telescopic guide rod, a handle, and a mounting bracket thereafter connecting the automatically extending telescoping guide rod in a pivotal manner to the mounting bracket to reduce stress in the automatically extending telescoping guide rod and tow line, thereafter positioning the skater on a skating device and having the skater hold the handle of the tow device connecting the skater to the handle of the tow device.

It will be seen that the pivotal connection between the tow device and the vehicle permits the telescopic guide rod to be automatically extended into pivot in the horizontal direction as well as the vertical direction. It should also be noted that the tow line is automatically rewound onto the device once tension on the tow line is discontinued or the skater disconnects from the handle of the tow device. As previously noted, the device is pivotally connected to allow the automatically extending telescoping guide rod to pivot in the horizontal direction and the vertical direction.

While the present invention has been described with regards to particular embodiments, it is recognized that additional variations of the present invention may be devised without departing from the inventive concept.

What is claimed is:

1. A tow device capable of towing a wheeled member behind a vehicle comprising:

(a) a hollow automatically extending telescoping rod having an attachment end and a cantilevered end, wherein the hollow automatically extending telescoping rod is longitudinally adjustable between an extended position and a retracted position automatically;

(b) a tow line having a bobbin end and a handle end and extending longitudinally through the hollow automatically extending telescoping rod;

(c) a handle connected to the handle end of the tow line;

(d) a spring-loaded bobbin connected to the bobbin end of the tow line and which applies a continuous tensile force to the bobbin end of the tow line to automatically and continually wind the tow line around the spring-loaded bobbin; and (e) a mounting bracket for connecting the attachment end of the hollow automatically extending telescoping rod to a vehicle.

2. The tow device of claim 1 wherein the automatically extending hollow telescoping rod is pivotally attached to the mounting bracket, permitting the hollow telescoping rod to pivot horizontally and vertically.

3. The tow device of claim 2 wherein the automatically extending hollow telescoping rod is spring loaded to return to a neutral position of the mounting bracket, wherein the neutral position is parallel to the direction of travel of the towing vehicle.

4. The tow device of claim 3 wherein the tow device further comprises a stop to limit the pivoting of the automatically extending hollow telescoping rod.

5. The tow device of claim 1 wherein the spring-loaded bobbin comprises:

(a) a housing;

(b) an axle attached to the housing;

(c) a bobbin concentric to the axle; and (d) a helicoid spring having a first end attached to the axle and a second end attached to the bobbin and being concentric to the axle and the bobbin, such that the helicoid spring, when under tension, tends to rotate the bobbin about the axle.

6. The tow device of claim 5 wherein the automatically extending hollow telescoping rod is pivotally attached to the mounting bracket, permitting the hollow telescoping rod to pivot horizontally and vertically.

7. The tow device of claim 6 wherein the automatically extending hollow telescoping rod is spring loaded to return to the neutral position of the mounting bracket, wherein the neutral position is parallel to the direction of travel of the towing vehicle.

8. The tow device of claim 7 wherein the tow device further comprises a stop to limit the pivoting of the automatically extending hollow telescoping rod.

9. A tow device capable of towing a skater or the like behind a vehicle comprising:

(a) a hollow telescoping rod having an attachment end and a cantilevered end, wherein the hollow telescoping rod is longitudinally adjustable between an extended position and a retracted position;

(b) a tow line having a bobbin end and a handle end and extending longitudinally through the hollow telescoping rod;

(c) a handle connected to the handle end of the tow line;

(d) a spring-loaded bobbin connected to the bobbin end of the tow line and which applies a tensile force to the bobbin end of the tow line to wind the tow line around the spring-loaded bobbin;

(e) a mounting bracket for connecting the attachment end of the hollow telescoping rod to a vehicle; and (f) a structure for automatically elongating the hollow telescoping rod to its extended position when the tow line is unwound from the spring-loaded bobbin by a tensile force applied to the handle end of the tow line, wherein an enlarged portion of the tow line engages a constricted portion of the hollow telescoping rod causing the hollow telescoping rod to extend in the direction of the tensile force applied to the handle end of the tow line.

10. The tow device of claim 9 wherein the hollow telescoping rod is pivotally attached to the mounting bracket, permitting the hollow telescoping rod to pivot horizontally and vertically.

11. The tow device of claim 10 wherein the hollow telescoping rod is spring loaded to return to a neutral position of the mounting bracket, wherein the neutral position is parallel to the direction of travel of the towing vehicle.

12. The tow device of claim 11 wherein the tow device further comprises a stop to limit the pivoting of the hollow telescoping rod.

13. The tow device of claim 9 wherein the spring-loaded bobbin comprises:

(a) a housing;

(b) an axle attached to the housing;

(c) a bobbin concentric to the axle; and (d) a helicoid spring having a first end attached to the axle and a second end attached to the bobbin and being concentric to the axle and the bobbin, such that the helicoid spring, when under tension, tends to rotate the bobbin about the axle.

14. The tow device of claim 13 wherein the hollow telescoping rod is pivotally attached to the mounting bracket, permitting the hollow telescoping rod to pivot horizontally and vertically.

15. The tow device of claim 14 wherein the hollow telescoping rod is spring loaded to return to a neutral position of the mounting bracket, wherein the neutral position is parallel to the direction of travel of the towing vehicle.

16. The tow device of claim 15 wherein the tow device further comprises a stop to limit the pivoting of the hollow telescoping rod.

17. The tow device of claim 9 wherein the structure for automatically elongating the hollow telescoping rod comprises:

(a) an aperture at the cantilevered end of the hollow telescoping rod through which the tow line extends; and (b) a tow line protuberance near the bobbin end of the tow line wherein the tow line protuberance is sized to allow it to pass through the hollow telescoping rod but not through the aperture, permitting the tow line protuberance to engage the aperture such that the hollow telescoping rod is elongated to its extended position when tension is applied to the handle end of the tow line.

18. The tow device of claim 17 wherein the hollow telescoping rod is pivotally attached to the mounting bracket, permitting the hollow telescoping rod to pivot horizontally and vertically.

19. The tow device of claim 18 wherein the hollow telescoping rod is spring loaded to return to a neutral position of the mounting bracket, wherein the neutral position is parallel to the direction of travel of the towing vehicle.

20. The tow device of claim 19 wherein the tow device further comprises a stop to limit the pivoting of the hollow telescoping rod.

21. The tow device of claim 17 wherein the spring-loaded bobbin comprises:

(a) a housing;

(b) an axle attached to the housing;

(c) a bobbin concentric to the axle; and (d) a helicoid spring having a first end attached to the axle and a second end attached to the bobbin and being concentric to the axle and the bobbin, such that the helicoid spring, when under tension, tends to rotate the bobbin about the axle.

22. The tow device of claim 21 wherein the hollow telescoping rod is pivotally attached to the mounting bracket, permitting the hollow telescoping rod to pivot horizontally and vertically.

23. The tow device of claim 22 wherein the hollow telescoping rod is spring loaded to return to a neutral position of the mounting bracket, wherein the neutral position is parallel to the direction of travel of the towing vehicle.

24. The tow device of claim 23 wherein the tow device further comprises a stop to limit the pivoting of the hollow telescoping rod.

25. A method for towing a skater behind a vehicle comprising the steps of:

a. connecting a tow device to the vehicle, the tow device having a tow line, an automatically extending telescoping guide rod, a handle, and a mounting bracket;

b. connecting the automatically extending telescoping guide rod pivotally to the mounting bracket to reduce stress in the automatically extending telescoping guide rod and tow line;

c. positioning the skater on a skating device;

d. having the skater hold the handle of the tow device;

e. propelling the vehicle;

f. creating tension in the tow line by the vehicle moving away from the skater and the tow device overcoming the skater's inertia;

g. elongating the telescoping guide rod to an extended position when tension is present in the tow line; and h. pulling the skater on the skating device.

26. The method of claim 25 wherein the pivotal connection between the tow device and the vehicle permits the telescoping guide rod to pivot in the horizontal direction.

27. The method of claim 25 wherein the pivotal connection between the tow device and the vehicle permits the telescoping guide rod to pivot in the horizontal direction and in the vertical direction.

28. The method of claim 25 further comprising the step of rewinding the tow line into the tow device when the skater disconnects from the handle of the tow device.

29. The method of claim 28 wherein the pivotal connection between the tow device and the vehicle permits the telescoping guide rod to pivot in the horizontal direction.

30. The method of claim 28 wherein the pivotal connection between the tow device and the vehicle permits the telescoping guide rod to pivot in the horizontal direction and in the vertical direction.

* * * * *